United States Patent [19]

Barten

[11] 4,432,221

[45] Feb. 21, 1984

[54] ROLLING MILL WITH CONVEYING MEANS FOR STRIP AND FOIL MATERIALS

[76] Inventor: Ernst H. Barten, Siegener Strasse 152, D-5910 Kreuztal, Fed. Rep. of Germany

[21] Appl. No.: 307,200

[22] Filed: Sep. 30, 1981

[30] Foreign Application Priority Data

Sep. 30, 1980 [DE] Fed. Rep. of Germany ..... 3036794

[51] Int. Cl.[3] ..... B21C 47/12; B21B 39/14

[52] U.S. Cl. ..... 72/148; 72/250; 242/195; 242/78.3; 226/97

[58] Field of Search ..... 72/250, 251, 252, 428, 72/148; 226/91, 92, 97, 108; 242/74, 78, 78.1, 78.3, 78.6, 78.8, 195

[56] References Cited

U.S. PATENT DOCUMENTS

| | | | |
|---|---|---|---|
| 3,976,237 | 8/1976 | Bossons | 226/97 |
| 4,069,989 | 1/1978 | Pfeifer et al. | 242/195 |
| 4,138,074 | 2/1979 | Ross et al. | 242/78.1 |

FOREIGN PATENT DOCUMENTS

| | | | |
|---|---|---|---|
| 2514164 | 10/1976 | Fed. Rep. of Germany | 226/97 |

*Primary Examiner*—Francis S. Husar
*Assistant Examiner*—Jorji M. Griffin
*Attorney, Agent, or Firm*—Young & Thompson

[57] ABSTRACT

A rolling mill for strip and foil material, comprises a roll stand and a coiler for rolled material downstream of the roll stand. An endless belt is trained about the material on the coiler, and an air cushion conveyor is provided for introducing the material between the coiler and the endless belt. The air cushion conveyor and the endless belt are both mounted on the same frame, which frame is mounted for swinging movement between an operative position in which the air cushion conveyor is disposed adjacent the path of the material and the endless belt is trained about the material on the coiler, on the one hand, and on the other hand an inoperative position in which the frame is swung away from the material and the coiler. The pivotal axis about which the frame swings is adjacent that end of the air cushion conveyor which is remote from the endless belt. That axis is disposed beneath the material as the material passes from the roll stand to the coiler. The operative position of the frame is a raised position and the inoperative position of the frame is a lowered position.

6 Claims, 5 Drawing Figures

ROLLING MILL WITH CONVEYING MEANS FOR STRIP AND FOIL MATERIALS

The invention relates to rolling mills with conveying means for metal strip and foil materials.

When rolling thin strip material having an initial thickness of the order of, say, 12 microns to a final thickness of 5–6 microns, the threading of the leading end of the strip which, at the start of the rolling process, is uncoiling from a motor-driven strip reel into the roll gap of the working rolls of a rolling mill, and the conveyance of the rolled leading end emerging from the rolling mill to the coiler, cause considerable difficulties. Since the roll gap is difficult of access, there is a danger that the thin strip material in the strip-entry section may be rejected and possibly become entangled.

Heretofore, the strip was usually threaded manually, which is an extremely awkward operation. In the past, the guidance of the leading end of the strip emerging from the roll gap of the working rolls to the coiler was mostly done by hand with the aid of tongs. During this manual transport, a great deal of effort is required to bring the leading end of the strip to the coiler, because the strip warps very easily due to the very small thickness of the strip and the residual stresses that may exist in the roll and it is subject to wrinkling if no constant drawing stress is applied across the entire width of the strip. However, the application of a constant drawing stress during the manual conveyance of the leading end of the strip to the coiler is well-nigh impossible.

Linear motors consisting of a stator generator are employed as conveyors to thread foil strip into rolling mills. The foil strip is guided through an air gap and is conveyed further as a motor armature by the resulting magnetic forces. These linear motors have the disadvantage that the forces of magnetic attraction in the direction of the stator generator are very large in comparison to the magnetic forces that move the foil strip forward.

Another drawback is that the air gap between stator generator and foil strip must be kept large in order to prevent the strip from being damaged. This increases the cost of the conveyor.

Another disadvantage is the dependence of the linear-motor efficiency on the electrical conductivity of the strip material. Still another drawback, aside from the high manufacturing cost of the linear motor, is the necessity of providing expensive protective devices to prevent rolling oil from entering the motor, which would render it inoperative. The further possibility of providing additional delivery rolls for the threading of the thin strip requires extra space for the rolls and leads to the danger that the strip may tear with differing rotational speeds of the uncoiler and of the delivery rolls and when the rotational speeds of the rolls become excessive.

It is the object of the present invention to provide a rolling mill with mechanized conveyors for strip or foil material, which permit the leading end of a very thin strip which is uncoiling from a strip reel to be conveyed without wrinkling to the rolling mill and from the rolling mill to the coiler.

This problem is solved in accordance with the present invention by the provision of a rolling mill with conveyors for the strip and foil material, which are characterized by the features recited hereinafter.

The installation of air-cushion conveyors in the strip-entry and strip-exit sections of rolling mills, particularly of foil rolling mills, permits fully automatic threading of the strip into the rolling mill. By providing for removing the air-cushion conveyors during the operation of a rolling mill by means of lifting or swivelling devices, from the area of the strip-entry and strip-exit sections, the operational reliability of the conveyor is enhanced, since there is adequate space for delivery, deflection, and tension rolls in the strip-entry and strip-exit sections, which ensures proper entry of the material being rolled. The synchronous control of the lifting movement of the air-cushion conveyors and of the tension rolls in the strip-entry section results in good economy of drive units and in a considerable simplification of the strip-entry device.

The invention will now be described with reference to a practical embodiment shown in the drawing, in which.

Figure 1:
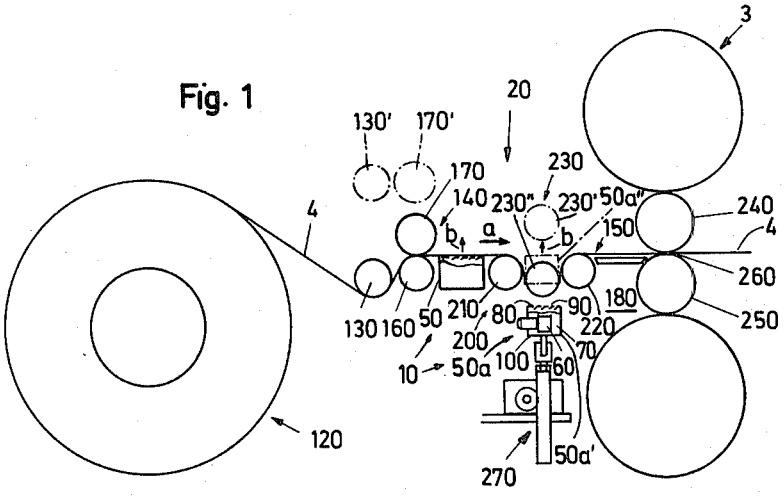
FIG. 1 is a side elevational view of the strip-entry section of a four-high stand of a foil rolling mill with a novel conveyor, according to the present invention.

The conveyor 10, which is mounted in the strip-entry section 20 of a four-high mill 3 for the rolling of thin strip or foil 4 with a final thickness in the order of, say, 6 microns, is provided with a number of air-cushion conveyors 50, 50*a*.

The air-cushion conveyors 50, 50*a* comprise a pressure duct 70 connected to a blower 60 having on its upper side 80 louvers 90 positioned obliquely upward in the foil-conveying direction and producing a vertical lifting-air component b and a horizontal delivery-air component in the direction of strip motion a. One or more exhaust openings 110 are provided in the bottom 100 of the pressure duct for any liquid (mainly rolling oil) that has entered the duct.

Figure 2:
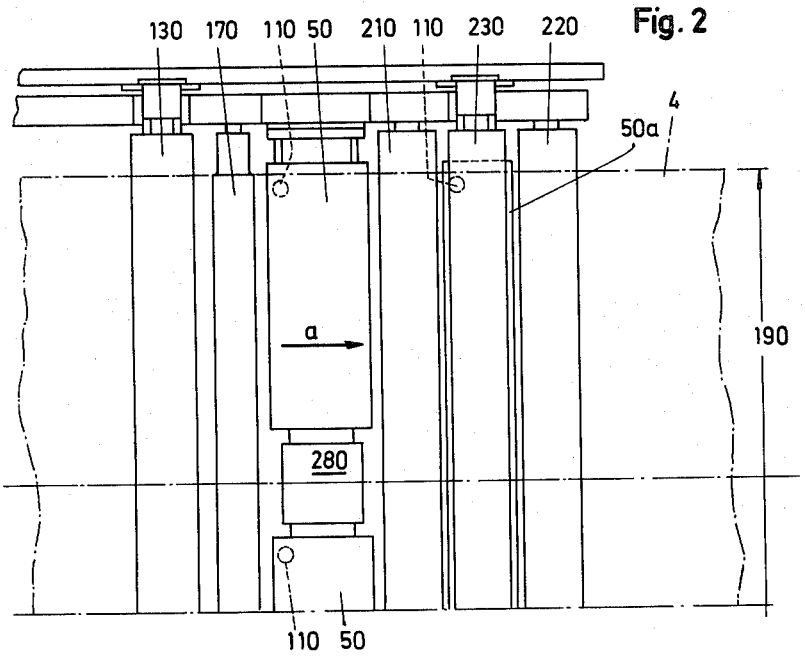
FIG. 2 is an enlarged partial top plan view of the strip-entry section shown in FIG. 1, but without the uncoiler and roll stand.

In the strip-entry section 20 shown in FIGS. 1 and 2, there is mounted behind the strip reel 120, from which uncoils the thin strip (with a thickness of, say, 12 microns) a tension roll 130 which can be raised and lowered perpendicularly to the direction of strip motion a. Downstream from the tension roll 130 there is mounted a trimming shear 140 with a fixed cutter block 160 disposed beneath the strip guide 150, as well as a cutter block 170 provided above the strip guide 150 and capable of being raised and lowered perpendicularly to the direction of strip motion a.

Downstream of the trimming shear 140 there are disposed in the strip-entry section 20, in the space 180 below the strip guide 150, two stationary air-cushion conveyors 50 extending in a direction perpendicular to the direction of strip motion a and spaced a distance from one another and which cover the maximum width 190 of the strip. A gage-measuring device 280 (FIG. 2) is disposed between the air-cushion conveyors 50.

Downstream of the air-cushion conveyors 50, the strip 4 passes through a roll unit 200 comprising two deflection rolls 210, 220 spaced a distance from one another in the direction of strip motion a and a tension roll 230 which can be lifted over the strip guide 150 and lowered into the space between the deflection rolls 210, 220 beneath the strip guide in order to stretch the strip 4.

When threading the strip 4 into the roll nip 260 of the four-high mill 3, the space between the deflection rolls 210, 220 is occupied by another air-cushion conveyor 50*a*, while the tension roll 230 is in the rest position 230' above the strip guide 150. The tension roll is lowered into the working position 230'' by means of the lifting gear. The air-cushion conveyor 50*a* is fixedly connected to the lifting gear 270 so that no additional lifting gear is needed for the conveyor. In the working position 50*a''* of the air-cushion conveyor 50*a*, the tension roll 230 is in the rest position 230'; and in the working position 230'' of the tension roll 230 the air-cushion conveyor 50*a* is in the rest postion 50*a'*.

Prior to threading the strip 4 into the four-high mill 3, the tennsion roll 130 and the upper cutter block 170 are lifted to their respective positions 130' and 170'. The air-cushion conveyor 50*a* is moved to its operating position 50*a''* by means of the lifting gear 270, with the tension roll 230 travelling to its rest position 230'. After the air-cushion conveyors 50, 50*a* enter into operation, the leading end of the strip 4 uncoiling from the driven strip reel 120 is manually guided to the air-cushion conveyors 50 and is advanced thereby in the direction a in which the strip is moving across the deflection roll 210 to the next air-cushion conveyor 50*a* and is advanced by the latter to the roll nip 260.

In this roll nip 260, the leading end of the strip is seized by the rotating working rolls 240, 250 and the blowers 60 of the air-cushion conveyors 50, 50*a* are switched off. Thereupon, the tension roll 130 and the upper cutter block 170 are lowered from their respective rest positions 130' and 170' to their respective operating positions 130 and 170. The tension roll 230 is likewise moved from its rest position 230' to the operating position 230'' between the deflection rolls 210 and 220, thereby forming a downwardly-extending bight in the foil, with the coincidental lowering of the air-cushion conveyor 50*a* from its operating position 50*a''* to its rest position 50*a'*. Mill 3 can now be put into operation, with the roll unit 200 ensuring the even feeding of the strip into the roll nip 260.

Figures 3, 5:
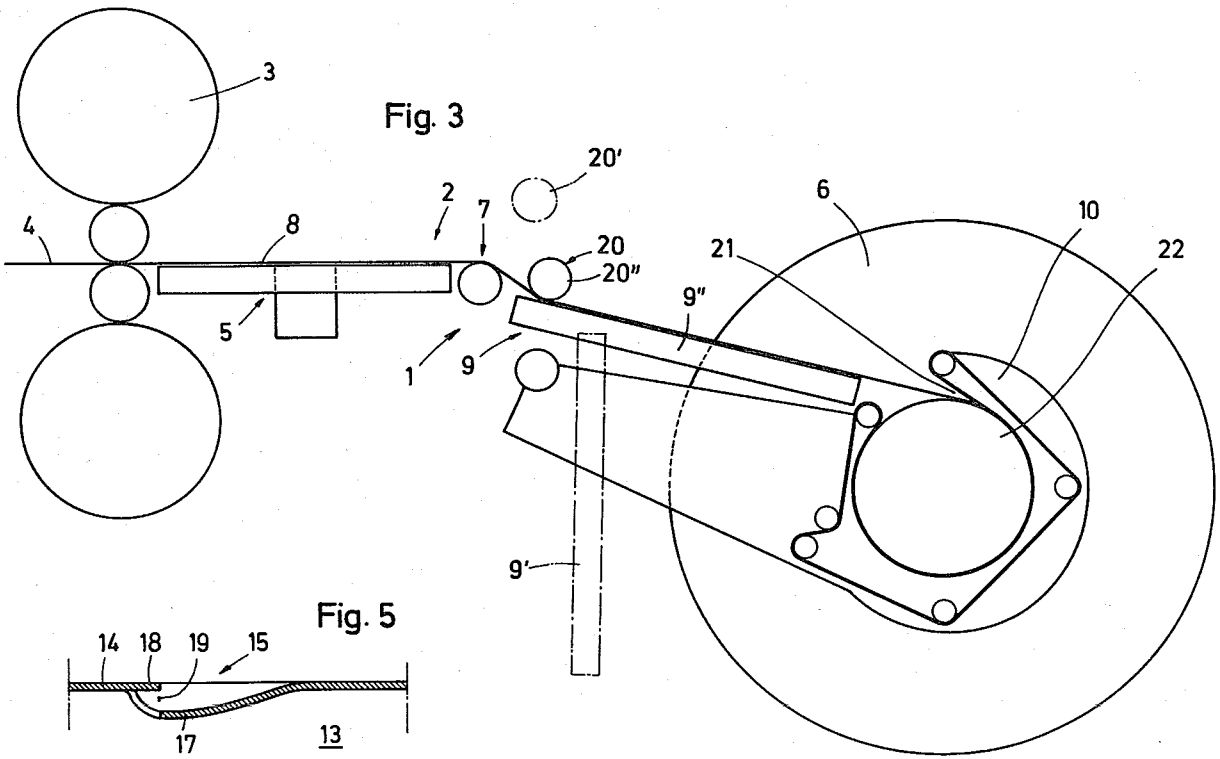
FIG. 3 is a side elevational view of the strip-exit section in the four-high stand of a foil mill with the novel conveyor.
FIG. 5 is an enlarged longitudinal sectional view of a blow hole of a plenum used as an air-cushion conveyor, taken on the line V—V of FIG. 4.

The conveyor 1 (see FIG. 3), which is mounted in the strip-exit section 2 of a four-high mill 3 designed to roll thin foil or strip 4 with an initial thickness of, say, 12 microns, to a final thickness of 5–6 microns, has a first air-cushion conveyor 5 disposed between mill 3 and a deflection/tension roll pair beneath the strip guide 8 and located upstream of the coiler 6, and a second air-cushion conveyor 9 which is fastened to the belt embracer 10 of the coiler and can be swivelled therewith from its rest position 9' to its operating position 9'' and vice versa.

Figure 4:
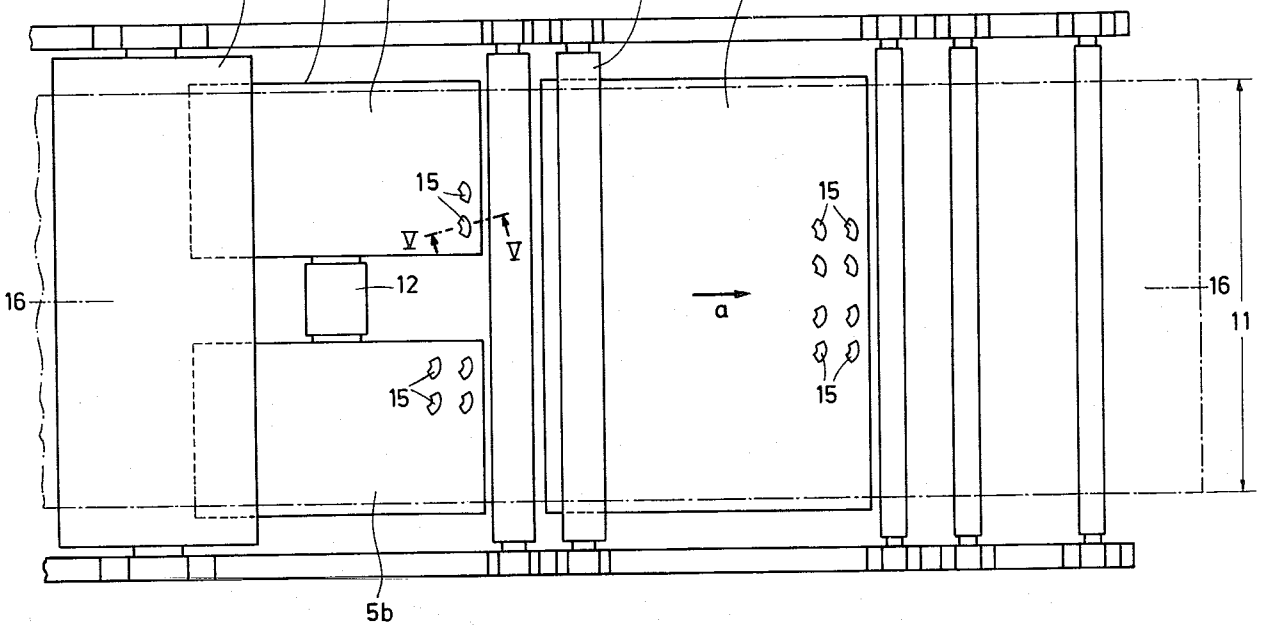
FIG. 4 is a top plan view of the strip-exit section of FIG. 3.

The first air-cushion conveyor 5 comprises two single conveyors 5*a* and 5*b* (see FIG. 4) spaced a distance from one another in a direction perpendicular to the direction a in which the strip is moving. Like the second air-cushion conveyor 9 which is secured to the embracer 10, these single conveyors 5*a* and 5*b* cover the full width 11 of the strip. A gage-measuring device 12 is disposed between the two air-cushion conveyors 5*a* and 5*b*.

The air-cushion conveyors 5, 9 comprise a blow top 13 of known construction with a cover 14 in which blow holes 15 are arranged in series and directed obliquely outward at an acute angle of, say, 15° in relation to the direction of strip motion a and are placed symmetrically to one another with respect to the central longitudinal axis 16—16 of the strip-exit section.

The blow holes 15 each have a guide surface 17 (see FIG. 5) which is imbossed in the blow top 13 and disposed in the manner of a circular sector about a lug 18 located in the cover 14 of the blow top, forming therewith an aperture cross-section 19 with a divergent jet direction.

By virtue of the arrangement of the blow holes 15 directed obliquely outward in the direction of strip motion a and formed symmetrically to the central longitudinal axis 16—16 of the strip-exit section 2, an air cushion is produced with a main delivery flow in the direction of strip motion a, as well as two equally strong cross flows aimed outwardly in opposite directions from the central longitudinal axis 16—16 and with a delivery pressure which is substantially smaller than that of the main delivery flow. The main delivery flow and the cross flows of the air-cushion conveyors 5 and 9 cause the leading end of the strip emerging from the four-high mill 3 to be mechanically conveyed to the coiler 6 and, as a result of the spreading effect produced, the strip 4, through the interaction of the main and cross flows of the air-cushion conveyors 5 and 9, is guided without wrinkles and with directional stability to the belt embracer 10 of the coiler.

As the leading end of the strip emerging from the four-high mill 3 is being advanced at a low speed to the coiler 6, the tension roll 20 of the deflection/tension roll pair 7 is lifted to its rest position 20' above the strip guide 8 so that the leading end of the strip can be guided without hindrance through the air-cushion coneyors 5 and 9 into the threading gap 21 between the belt embracer 10 and the drum 22. As soon as a few coils of strip are wound onto the drum 22 of the coiler 6 by means of the belt embracer 10, the latter is swung down away from the coiler 6 to a position below the strip guide 8 so that the air-cushion conveyor 9 passes from the operating position 9'' to the rest position 9'. Then, the tension roll 20 of the deflection/tension roll pair 7 is lowered from the rest position 20' to the operating position 20'' and the mill 3 is operated at its maximum rolling speed.

From a consideration of the foregoing disclosure, therefore, it will be evident that the initially recited object of the invention has been achieved.

Although the present invention has been described and illustrated in connection with a preferred embodiment, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. A rolling mill for strip and foil material, comprising a roll stand, a coiler for rolled material downstream of the roll stand, and endless belt, means to train the endless belt about material on the coiler, air cushion conveyor means for introducing material between the coiler and the endless belt, a frame on which both said air cushion conveyor means and said endless belt are mounted, and means mounting said frame for swinging movement between an operative position in which said air cushion conveyor means is disposed adjacent the path of said material and the endless belt is trained about the material on the coiler, on the one hand, and on the other hand an inoperative position in which the frame is swung away from the material and the coiler.

2. A rolling mill as claimed in claim 1, said mounting means for said frame mounting said frame for vertical swinging movement about a horizontal axis which is disposed adjacent an end of said air cushion conveyor means which is remote from said endless belt, said axis being disposed beneath said material as said material passes from said roll stand to said coiler, said operative position of said frame being a raised position and said inoperative position being a lowered position.

3. A rolling mill as claimed in claim 1, said air cushion conveyor means comprising a plenum for air under pressure having a wall adjacent the material, and a multiplicity of openings through the wall, said openings extending obliquely laterally outwardly and in the conveying direction of the material.

4. A rolling mill as claimed in claim 3, said openings being defined by imbossed surfaces of said wall that extend from a lowermost open upstream end obliquely upwardly to the plane of the wall.

5. A rolling mill as claimed in claim 4, said imbossed portions of the wall being of arcuate shape as viewed in a direction perpendicular to the wall and partially surrounding a lug in the plane of the wall, whereby air leaving a said opening moves not only in the conveying direction of the material but also to opposite sides of that direction.

6. A rolling mill as claimed in claim 5, each said arcuate imbossed portion having a plane of symmetry, the planes of symmetry of said openings on each of the longitudinal center line of the rolling mill extending obliquely forwardly and laterally outwardly when seen in a direction perpendicular to the material.

* * * * *